United States Patent [19]

Kokoruda et al.

[11] Patent Number: 5,060,900

[45] Date of Patent: Oct. 29, 1991

[54] MOUNTING BOARD FOR RURAL-TYPE MAILBOXES

[76] Inventors: Robert D. Kokoruda, 26 Saxony Dr., Trumbull, Conn. 06611; Albert L. Harlow, Jr., 9 Chatham Dr., Aurora, Ohio 44202

[21] Appl. No.: 450,042

[22] Filed: Dec. 13, 1989

[51] Int. Cl.[5] ..... B65D 91/00; A47G 29/12

[52] U.S. Cl. ..... 248/311.2; 248/146; 232/39

[58] Field of Search ..... 232/39, 17; 248/311.2, 248/146

[56] References Cited

U.S. PATENT DOCUMENTS

| | | | |
|---|---|---|---|
| 1,994,186 | 3/1935 | Anderson | 232/39 |
| 3,497,078 | 2/1970 | Nash | 232/39 |
| 4,213,560 | 7/1980 | Hall | 232/39 |
| 4,600,143 | 7/1986 | Harlow | 232/17 |
| 4,601,364 | 7/1986 | York | 182/46 |
| 4,877,180 | 10/1989 | Shull | 232/17 |

*Primary Examiner*—Reinaldo P. Machado
*Attorney, Agent, or Firm*—Ware, Fressola, Van Der Sluys & Adolphson

[57] ABSTRACT

A durable plastic mounting board is used in attaching a rural-type mailbox to various styles of vertical posts. The mounting board includes a variety of mounting apertures used in different combinations to accommodate the various vertical post styles. Flexible tabs are provided on the sidewalls of the mounting board thereby adapting it to adjust to the manufacturing tolerances found in mailboxes presently on the market.

27 Claims, 2 Drawing Sheets

MOUNTING BOARD FOR RURAL-TYPE MAILBOXES

BACKGROUND OF THE INVENTION

The present invention relates generally to mailboxes used on rural mail delivery routes, and more particularly to mounting boards used to secure rural type mailboxes to their vertical posts Conventionally, U.S. Postal Service approved mailboxes with pivotally attached doors and mechanical latching devices have been used for many years on rural mail delivery routes. These mailboxes have traditionally been mounted on vertical posts at the curb side at a height prescribed by the Postal Service. In attaching a mailbox to its vertical post, a wooden mounting board, dimension to fit within open area defined in the bottom of the mailbox, is nailed or otherwise secured to the wooden post and the mailbox is in turn secured by screws or nails to the mounting board. While such mounting boards have been used for years, they do exhibit several drawbacks such as they are subject to decay, they are inconvenient to use and they do not provide the flexibility of use on a plurality of different types of mailbox installations.

The present invention is designed to overcome the abovenoted limitations that are attendant upon the use of the conventional rural type mailbox, and toward this end, it contemplates the provision of a novel mounting board molded of durable plastic material.

It is an object of the invention to provide such a mounting board which can be universally used in various mailbox installations.

It is also an object to provide such a device which will meet the standards and specifications of the U.S. Postal Service.

Still another object is to provide such a device which will replace the inconvenient and hard-to-use wooden mounting board.

A further object is to provide such a device which may be readily and economically fabricated and will enjoy a long life in operation.

SUMMARY OF THE INVENTION

It has now been found that the foregoing and related objects can be readily attained in a mounting board for use attaching a conventional U.S. Postal Service approved rural mailbox to various styles of vertical posts. The mailbox has a bottom panel, a back panel and a U-shaped roof portion. The bottom panel, the back panel and the U-shaped roof portion define a cavity in a bottom portion of the mailbox for receiving the mounting board and an enclosure with an entrance opening at one end thereof. The mailbox further includes a door member pivotally mounted adjacent the entrance opening for movement between an open position permitting access to the enclosure through the entrance opening and a closed position covering the entrance opening.

The mounting board includes a top wall having a generally rectangular configuration and a pair of sidewalls and endwalls extending downwardly from the top wall and cooperating therewith to define a generally rectangular cavity. The top wall has ribs extending thereacross in the rectangular cavity to provide structural support to the mounting board. The sidewalls include flexible tabs cantilevered from the top wall for mounting the mailbox thereto. The ribs and endwalls are of even height adapting them to be seatable on a cantilevered arm of one style of mounting post.

Conveniently, a pocket is defined in the top wall and extends into the rectangular cavity. The pocket is dimensionally sized to accept an end portion of another style of mounting post. The top wall also defines two sets of apertures therethrough, one set opening into the pocket and another set opening into the rectangular cavity outside the pocket. The apertures are dimensionally sized to accept fasteners for securing the mounting board to the post.

According to the invention, the tabs of the sidewalls define openings dimensionally sized to accommodate fasteners for securing the mailbox to the mounting board. In its preferred form, the mounting board is one piece and integrally molded of a plastic resin.

Our invention will be more fully understood when reference is made to the following detailed description taken in conjunction with the accompanying drawings.

DETAILED DESCRIPTION OF THE PREFERRED EMBODIMENT

Figure 1:
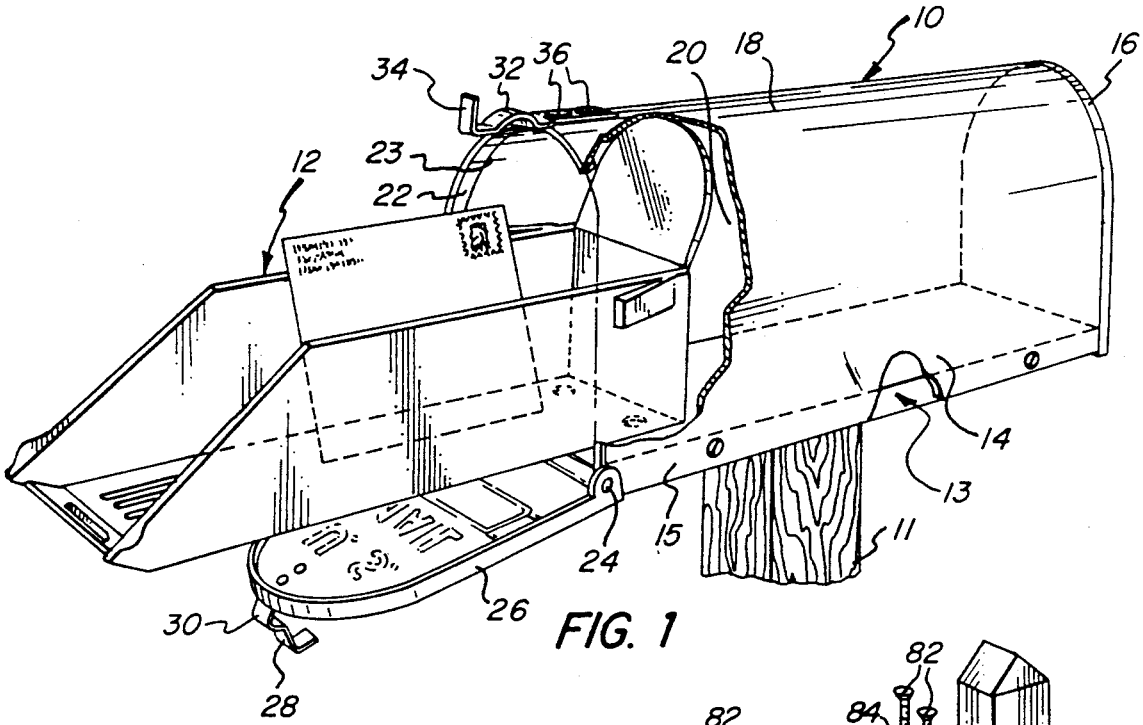
FIG. 1 is a perspective view of a mailbox and a tray insert with a portion of the mailbox partially broken away to show internal structure and the plastic universal mounting board of the present invention.

Referring first to FIG. 1, therein is illustrated a conventional rural type mailbox generally indicated by numeral 10 mounted on the novel mounting board of the present invention generally indicated by the numeral 13 which is in turn mounted to a vertical post 11 secured in the ground, and a tray insert generally designated by the numeral 12 used with the mailbox 10. The tray insert 12 is in the form of a drawer slideably seated within the mailbox 10 and is the subject of U.S. Pat. Nos. D292539, 4,600,143 and 4,714,192.

The mailbox 10 has a generally rectangular bottom panel 14 having downwardly projecting flange portions 15 around the periphery thereof defining an opening within which the mounting board 13 fits, an arcuately shaped back panel 16 extending upwardly from one end of the bottom panel 14, and an arcuately curved inverted U-shaped roof portion 18 spanning the bottom panel 14 and defining an enclosure 20 for receiving envelopes, parcel post packages and the like through an entrance opening 22 located at the anterior end thereof.

As best seen in FIG. 1, the roof portion 18 has a rolled abutment edge 23 at the entrance opening 22.

Pivotally attached by means of pivot pins 24 to the flange portions 15 and the lower end of the roof portion 18 adjacent the entrance opening 22 is a door or closure 26. The door 26 includes a finger hold 28 cantilevered therefrom at the distal end thereof to enable manipulation of the door 26 by a user between an open position permitting access to the enclosure 20 through the entrance opening 22 and a closed position covering the entrance opening 22. The finger hold 28 has a convexly raised portion 30 thereon for mating engagement with a concave recess 32 formed by a resilient latch 34. The latch 34 is cantilevered from the roof portion 18 by means of a pair of fastening elements 36 and is positioned in the arcuate path of movement of the door 26 and its finger hold 28. This arrangement enables the latch 34 to deflect upwardly when it is engaged by the finger hold 28 and provides a snug fit therebetween when the door 28 is in its closed position.

The mailbox 10 and its components are preferably stamped from corrosion-resistant sheet metal alloy material such as a galvanized steel or aluminum. The components are assembled by conventional welding, riveting or other metal forming techniques. Mailboxes of this same basic type are also molded of plastic such as high density polyethlene or polypropylene. To be in conformance with U.S. Postal Service standards, the mailbox 10 must accept certain parcel sizes and the opening 22 must have a certain minimum unrestricted area.

Figure 2:
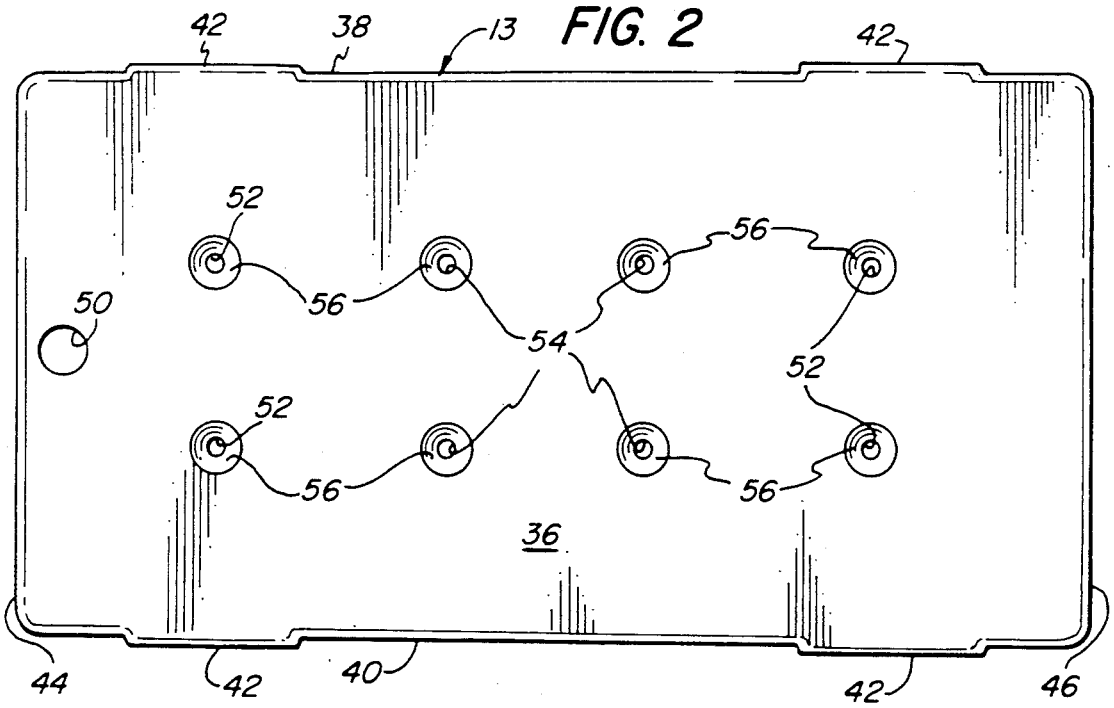
FIG. 2 is a top elevational view of the mounting board of the present invention.
Figure 3:
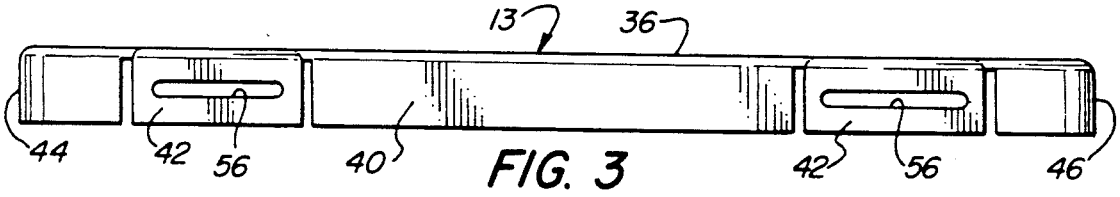
FIG. 3 is a side elevational view of the mounting board of the present invention.
Figure 4:
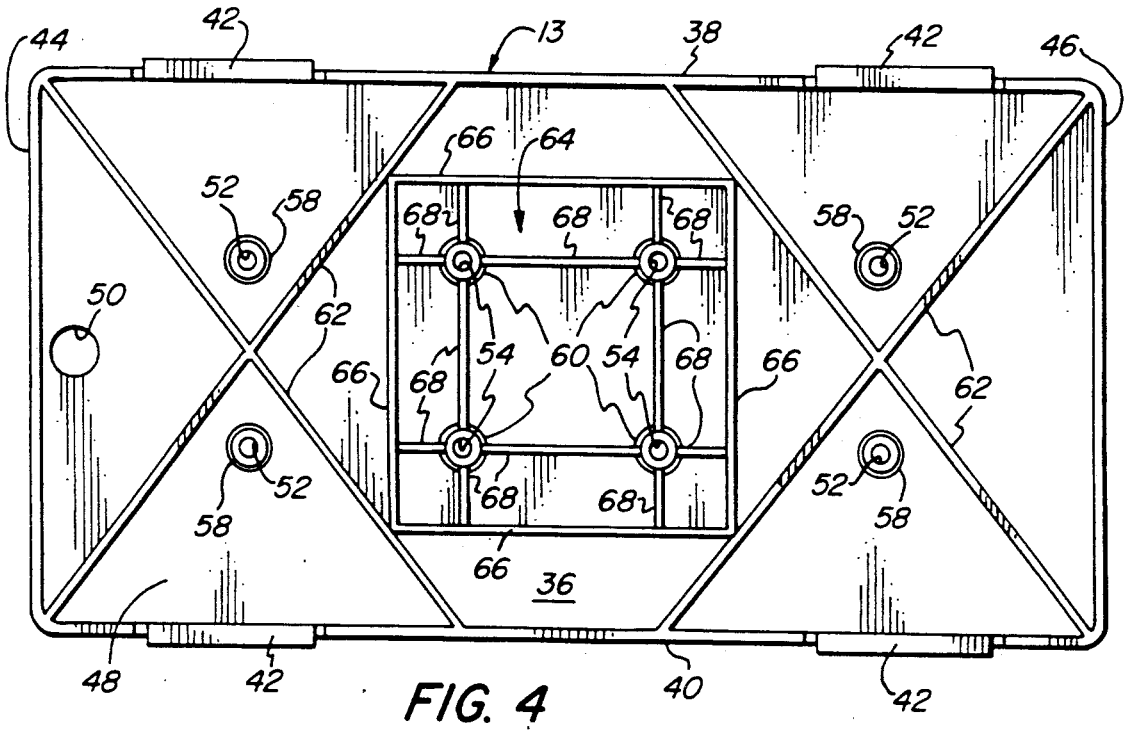
FIG. 4 is a bottom elevational view of the mounting board invention.

Referring now to FIGS. 2–4, the mounting board 13 of the present invention is dimensionally sized to fit snuggly within space created by the downwardly directed flange portions 15 of the mailbox 10. The mounting board 13 includes a top wall 36 having a generally rectangular configuration with a pair of generally parallel sidewalls 38, 40, each having a pair of flexible attachment tabs 42 extending outwardly therefrom. Projecting downwardly from the top wall and extending transversely between the sidewalls are a pair of endwalls 44, 46 whereby the top wall 36, sidewalls 38, 40 and endwalls 44, 46 define a generally rectangular cavity 48 (FIG. 4). As shown in FIG. 2, the top wall 36 is provided with a display aperture 50 adjacent to the endwall 44 allowing the mounting board 13 to be hung on a display rack in the retail store outlet. Formed in the upper surface of the top wall 36 of mounting board 13 spaced from but along the longitudinally axis are a plurality of mounting apertures 52, 54. The mounting apertures 52, 54 are provided with tapered seats 56 so that the heads of the wood screws to be fit in the mounting apertures 52, 54 will seat properly on the tapered seats 56 thereof.

As can be readily appreciated from FIG. 3, the flexible tabs 42 in the sidewalls 38, 40 are provided with elongated openings 56 so that the machine screws, which will hold the mounting board 13 and the mailbox 10 in place, can pass therethrough. As shown in FIG. 4, the mounting apertures 52, 54 are defined on the lower surface of the top wall 36 by mounting lands 58, 60 which extend in the cavity 48 and are of the same height as the sidewalls 38, 40 and endwalls 44, 46. Two pairs of cross-ribs 62 extend from the corners of the mounting board 13 at a diagonal to the opposite sidewall in a crossing pattern. The cross-ribs 62 have a height equal to the sidewalls 38, 40 and endwalls 44, 46 and provide structurally rigidity to the mounting board 13. Centrally located on the lower surface of the top wall 36 of the mounting board 13 is a mounting pocket generally indicated by the numeral 64 for the four inch by four inch (4"×4") vertical mounting post 11. The mounting pocket 64 is defined by four mounting ribs 66 extending perpendicular to one another to form a rectangular structure. The mounting ribs 66 have a height equal to the cross-ribs 62, sidewalls 38, 40 and endwalls 44, 46. Recessed within the rectangular pocket structure 64 formed by the mounting ribs 66 are the four centrally located mounting lands 60 defining the mounting apertures 54. Extending between adjacent mounting lands 60 and also between the mounting lands 60 and the mounting ribs 66 are a plurality of support ribs 68. The support ribs and mounting lands are of the same height which is significantly less than height of the surrounding the mounting ribs 66.

Figure 5:
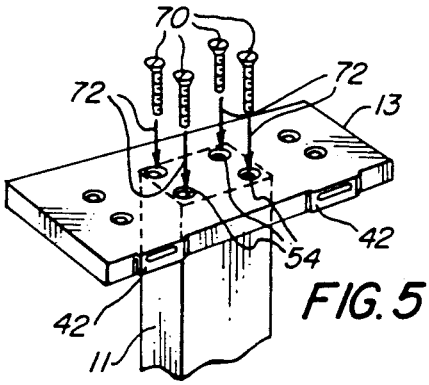
FIG. 5 is a perspective view of the mounting board of the present invention being installed on a vertical post.
Figure 6:
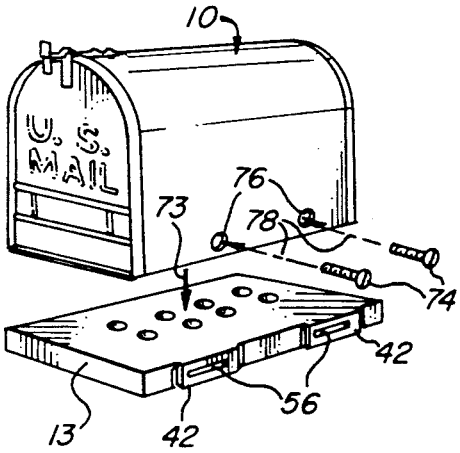
FIG. 6 is a perspective view of a mailbox being installed on the mounting board of the present invention.

Referring now to FIG. 5, in use, to secure the mounting board 13 to the four inch by four inch (4"×4") vertical post 11, the mounting board 13 is snuggly seated on the vertical post 11 with the top of the post 11 centrally located in the mounting pocket 64 defined by the mounting ribs 66. The mounting board 13 will sit on its support ribs 68 and the centrally located mounting lands 60 defined in the pocket 64. Four wood screws 70 are inserted downwardly as indicated by arrows 72 through the mounting apertures 54 and into the vertical post 11 until the screws 70 seat on the tapered seats 56 of the mounting board 13 so that they are flush or below the top surface of the top wall 36 thereof. Thereinafter, as shown in FIG. 6, the mailbox 10 is inserted over the mounting board 13 as indicated by arrow 73 and machine bolts 74 are passed in the direction of arrows 78 through holes 76 within the mailbox 10 and the elongated openings 56 of the mounting board in the flexible tabs 42 to be secured on the inside thereof by appropriate washers and nuts (not shown). Since the size of the opening defined by the flanges 15 of the mailbox 10 varies significantly from mailbox manufacturer to mailbox manufacturer, the flexible tabs 42 are designed to move and flex relative to the sidewalls 38, 40 to accommodate manufacturing tolerances found in various mailboxes.

Figure 7:
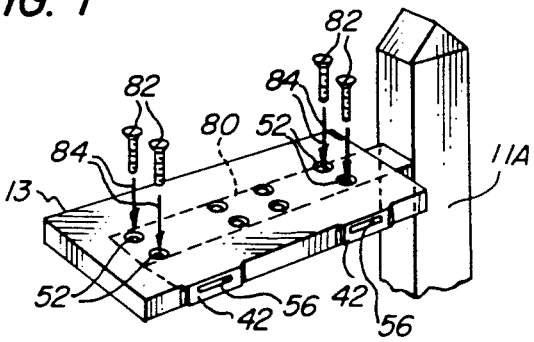
FIG. 7 is a perspective view of the mounting board of the present invention being installed on a wooden cantilevered arm from a wooden vertical post.

Turning now to FIG. 7, another possible mailbox installation for the mounting board 13 of the present invention is illustrated and has a wooden vertical post 11A with a cantilevered wooden arm 80. Instead of using the centrally located mounting pocket 64 the mounting board 13 rests on the arm 80 by means of its cross-ribs 62, lands 58, mounting ribs 66 and one (or both) of its endwalls 44, 46. The four mounting apertures 52 closer to the endwalls 44, 46 are used to mount the mounting board 13 on the cantilevered arm 80 using four wood screws 82 as indicated by arrows 84. Once the mounting board 13 is secured to the cantilevered wooden arm 80, the mailbox 10 can be installed thereon in the same fashion shown in FIG. 6.

Figure 8:
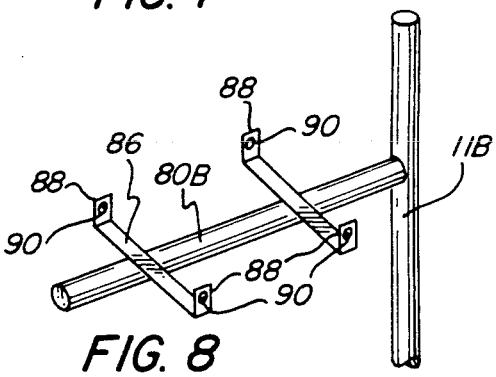
FIG. 8 is a perspective view of a metal vertical post having a metal cantilevered arm and with pair of metal brackets thereon.
Figure 9:
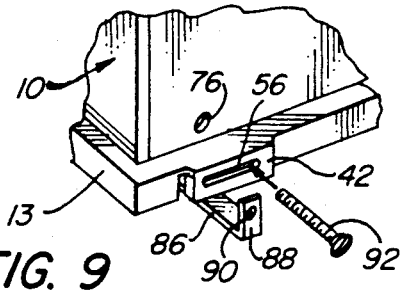
FIG. 9 is a fragmentary perspective view of a mailbox being mounted to the mounting board of FIGS. 2–4 and the metal posts and brackets shown in FIG. 8.

Yet another type of mailbox installation in which the mounting board 13 of the present invention is useful is shown in FIGS. 8-9. This involves a vertical metal post 11B and a cantilevered metal arm 80B having a pair of U-shaped metal brackets 86 thereon with upturned ends 88 having apertures 90 therein. As seen in FIG. 9, the mounting board 13 is inserted on the brackets 86 so that the upturned ends 88 are inside the flexible attachment tabs 42 thereof. Thereinafter, the mailbox 10 is inserted over the mounting board 13 and four machine screws 92 (only one shown) are inserted through the holes 76 in the mailbox 10, the elongated openings 56 in the flexible tabs 42 of the mounting board 13, and the holes 90 in the upturned ends 88 of the brackets 86. All these elements are secured in assembly with appropriate washers and nuts (not shown) which engage the screws 92 and the insides of the upturned ends 88.

The mounting board 13 is preferably a one-piece unit integrally molded from a plastic resin such as high density polyethylene or a polypropylene and homopolymer mixture but it should be apparent to those skilled in the art that it may be manufactured from other suitable materials which exhibit weather resistant qualities and the desired resiliency to permit the flexing movement of the flexible attachment tabs. The mounting board of the present invention can be made in a variety of sizes to conform to the various standard United States rural mailbox sizes.

Thus, it can be seen from the foregoing specification and the attached drawings that the mounting board of the present invention provides an effective means for facilitating installation of an associated mailbox on various types of vertical posts.

The preferred embodiment described above admirably achieves the objects of the invention; however, it will be appreciated that departure can be made by those skilled in the art without departing from the spirit and scope of the invention which is limited only by the following claims.

Having thus described the invention, what is claimed is:

1. A mounting board for use in attaching a rural mailbox to a vertical post arrangement, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a main body portion;

means on said main body portion for mounting said mounting board to a vertical post arrangement; and means on said main body portion for mounting a mailbox thereto, said mailbox mounting means being resiliently adjustable through resilient flexing thereof to accommodate various size cavities from a variety of mailboxes to allow the mounting board to snuggly fit within the cavities there defined.

2. A mounting board for use in attaching a rural mailbox to a vertical post arrangement, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a main body portion;

means on said main body portion for mounting said mounting board to a vertical post arrangement; and means on said main body portion for mounting a mailbox thereto, said mailbox mounting means being adjustable to accommodate various size cavities from a variety of mailboxes to allow the mounting board to snuggly fit within the cavities there defined, said mailbox mounting means is a plurality of tabs depending from said main body portion.

3. The mounting board in accordance with claim 2, wherein said tabs are flexibly cantilevered from said main body portion.

4. The mounting board in accordance with claim 2, wherein said tabs define openings dimensionally sized to accommodate fasteners for securing a mailbox to said mounting board.

5. The mounting board in accordance with claim 2, wherein said mounting board is one piece and integrally molded of a plastic resin.

6. A mounting board for use in attaching a rural mailbox to a vertical post, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a main body portion;

means on said main body portion for mounting said mounting board to a vertical post; and means on said main body portion for mounting a mailbox thereto, said mailbox mounting means being adjustable to accommodate various size cavities from a variety of mailboxes to allow the mounting board to snuggly fit within the cavities there defined, wherein said mounting board is one piece and integrally molded of a plastic resin.

7. A mounting board for use in attaching a rural mailbox to a vertical post, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a main body portion, said main body portion is a top wall having a generally rectangular configuration, extending downwardly from said top wall are a pair of sidewalls and a pair of endwalls cooperating with said top wall to define a generally rectangular cavity;

means on said main body portion for mounting said mounting board to a vertical post; and means on said main body portion for mounting a mailbox thereto, said mailbox mounting means being adjustable to accommodate various size cavities from a variety of mailboxes to allow the mounting board to snuggly fit within the cavities there defined.

8. The mounting board in accordance with claim 7, wherein said top wall has ribs extending thereacross in said rectangular cavity to provide structural support.

9. The mounting board in accordance with claim 7, wherein each of said sidewalls have a pair of flexible attachment tabs defining said mailbox mounting means.

10. The mounting board in accordance with claim 9, wherein said tabs are flexibly cantilevered from said main body portion.

11. The mounting board in accordance with claim 9, wherein said tabs define openings dimensionally sized to accommodate fasteners for securing a mailbox to said mounting board.

12. The mounting board in accordance with claim 8, wherein said ribs and endwalls are of even height and seat on a cantilevered arm of the vertical post to which said mounting board is secured.

13. The mounting board in accordance with claim 12, wherein said top wall defines apertures therethrough which open into said rectangular cavity and are dimensionally sized to accept fasteners for securing said mounting board to the vertical post.

14. The mounting board in accordance with claim 7, wherein said means to mount said mounting board to a vertical post is a pocket defined on said main body portion, said pocket is dimensionally sized to accept an end portion of the vertical post.

15. The mounting board in accordance with claim 14, wherein said main body portion defines apertures therethrough which open into said pocket and are dimensionally sized to accept fasteners for securing said mounting board to the vertical post.

16. A mounting board for use in attaching a rural mailbox to a vertical post arrangement, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a main body portion, said main body portion includes a top wall, extending downwardly from said top wall are a pair of sidewalls and a pair of endwalls;

means on said main body portion for mounting said mounting board to a vertical post arrangement including apertures defined through said main body portion, said apertures dimensionally sized to accept fasteners for securing said mounting board to the vertical post arrangement; and means on said main body portion for mounting a mailbox thereto, wherein said mounting board is one piece and integrally molded of a plastic resin.

17. A mounting board for use in attaching a rural mailbox to a vertical post, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted, adjacent said entrance opening for movement between an open position permitting access to the enclosure through the entrance opening and a closed position covering the entrance opening, comprising:

a main body portion, said main body portion is a top wall having a generally rectangular configuration, extending downwardly from said top wall are a pair of sidewalls and a pair of endwalls cooperating with said top wall to define a generally rectangular cavity;

means on said main body portion for mounting said mounting board to a vertical post including a pocket defined on said main body portion, said pocket dimensionally sized to accept an end portion of the vertical post; and means on said main body portion for mounting a mailbox thereto.

18. The mounting board in accordance with claim 17, wherein said pocket is located within said rectangular cavity.

19. The mounting board in accordance with claim 17, wherein said top wall has ribs extending thereacross in said rectangular cavity to provide structural support.

20. The mounting board in accordance with claim 19, wherein said ribs and endwalls are of even height and seat on a cantilevered arm of the vertical post to which said mounting board is secured 21. The mounting board in accordance with claim 20, wherein said top wall defines apertures therethrough which open into said rectangular cavity and are dimensionally sized to accept fasteners for securing said mounting board to the vertical post.

22. The mounting board in accordance with claim 21, wherein said main body portion defines apertures therethrough which open into said pocket and are dimensionally sized to accept fasteners for securing said mounting board to the vertical post.

23. A mounting board for use in attaching a rural mailbox to a vertical post, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted, adjacent said entrance opening for movement between an open position permitting access to the enclosure through the entrance opening and a closed position covering the entrance opening, comprising:

a main body portion;

means on said main body portion for mounting said mounting board to a vertical post including a pocket defined on said main body portion, said pocket dimensionally sized to accept an end portion of the vertical post; and means on said main body portion for mounting a mailbox thereto; wherein said mounting board is one piece and integrally molded of a plastic resin.

24. A mounting board for use in attaching a rural mailbox to a vertical post, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted, adjacent said entrance opening for movement between an open position permitting access to the enclosure through the entrance opening and a closed position covering the entrance opening, comprising:

a main body portion;

means on said main body portion for mounting said mounting board to a vertical post including a pocket defined on said main body portion, said pocket dimensionally sized to accept an end portion of the vertical post; and means on said main body portion for mounting a mailbox thereto; wherein said main body portion defines apertures therethrough which open into said pocket and are dimensionally sized to accept fasteners for securing said mounting board to the vertical post.

25. A mounting board for use in attaching a rural mailbox to a vertical post having a cantilevered arm thereon, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a main body portion, wherein said main body portion is a top wall having a generally rectangular configuration, extending downwardly from said top wall are a pair of sidewalls and a pair of endwalls cooperating with said top wall to define a generally rectangular cavity, said top wall having ribs extending thereacross in said rectangular cavity to provide structural support;

means on said main body portion for mounting said mounting board to a vertical post, said ribs and at least one of said endwalls are of even height and are adapted to sit on the cantilevered arm of the vertical post to which said mounting board is secured, said top wall defines apertures therethrough which open into said rectangular cavity and are dimensionally sized to accept fasteners for securing said mounting board to the vertical post; and means on said main body portion for mounting a mailbox thereto.

26. The mounting board in accordance with claim 25, wherein said mounting board is one piece and integrally molded of a plastic resin.

27. A mounting board for use attaching a rural mailbox to a post, the mailbox having a bottom panel, a back panel and a U-shaped roof portion, the bottom panel, the back panel and the U-shaped roof portion defining a cavity in a bottom portion of the mailbox for receiving said mounting board and an enclosure with an entrance opening at one end thereof, and the mailbox further including a door member pivotally mounted adjacent said entrance opening for movement between an open position permitting access to the enclosure through the entrance opening and a closed position covering the entrance opening, comprising:

a top wall having a generally rectangular configuration;

a pair of sidewalls and endwalls extending downwardly from said top wall and cooperating therewith to define a generally rectangular cavity, said top wall having ribs extending thereacross in said rectangular cavity to provide structural support, said sidewalls having flexible tabs thereon for mounting a mailbox thereto, said ribs and endwalls are of even height adapting them to be seatable on a cantilevered arm of the post;

pocket means defined in said top wall and extending into said rectangular cavity, said pocket dimensionally sized to accept a end portion of the post; and said top wall defining two sets of apertures therethrough, one set opening into said pocket and another set opening into said rectangular cavity outside said pocket, said apertures dimensionally sized to accept fasteners for securing said mounting board to the post.

* * * * *

UNITED STATES PATENT AND TRADEMARK OFFICE

CERTIFICATE OF CORRECTION

PATENT NO. : 5,060,900

DATED : October 29, 1991

INVENTOR(S) : Kokoruda, et al.

It is certified that error appears in the above-identified patent and that said Letters Patent is hereby corrected as shown below:

Col. 1, line 9, after "posts" insert a --.--;

Col. 1, line 28, change "abovenoted" to --above-noted--;

Col. 6, line 16, Cl. 6, after "post" insert --arrangement--;

Col. 6, line 29, after "post" insert --arrangement--;

Col. 6, line 38, after "post" insert --arrangement--;

Col. 6, line 56, after "post" insert --arrangement--;

Signed and Sealed this

Twenty-seventh Day of April, 1993

*Attest:*

MICHAEL K. KIRK

*Attesting Officer*

*Acting Commissioner of Patents and Trademarks*